US006978904B1

(12) United States Patent
Lam

(10) Patent No.: US 6,978,904 B1
(45) Date of Patent: Dec. 27, 2005

(54) GARMENT SUPPORTING STAND

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 40 days.

(21) Appl. No.: 10/645,083

(22) Filed: Aug. 21, 2003

Related U.S. Application Data

(63) Continuation-in-part of application No. 09/704,952, filed on Nov. 2, 2000, now abandoned.

(51) Int. Cl.[7] ..... A47F 7/00
(52) U.S. Cl. ..... 211/85.3; 211/1; 211/85.7
(58) Field of Search ..... 211/85.3, 1, 85.7, 211/99, 13.1, 124, 149, 194, 163, 195, 150, 211/198; 312/249.2, 249.6

(56) References Cited

U.S. PATENT DOCUMENTS

| | | | | |
|---|---|---|---|---|
| 31,481 | A * | 2/1861 | Jones | 24/191 |
| 720,833 | A * | 2/1903 | Messick | 211/85.3 |
| 1,557,251 | A * | 10/1925 | Hamlin | 211/85.3 |
| 1,804,069 | A * | 5/1931 | Stover | 211/85.3 |
| 2,114,424 | A * | 4/1938 | Jesse et al. | 211/85.3 |
| 2,120,511 | A * | 6/1938 | Risdon | 211/85.3 |
| 3,831,768 | A * | 8/1974 | Keller | 211/1 |
| 4,204,601 | A * | 5/1980 | Thomas | 211/4 |
| 4,889,246 | A * | 12/1989 | Lee | 211/163 |
| 5,318,189 | A * | 6/1994 | Lee | 211/205 |
| 5,511,701 | A * | 4/1996 | Lam | 223/85 |
| 5,542,758 | A * | 8/1996 | Brown | 312/249.2 |
| 6,726,033 | B2 * | 4/2004 | Sparkowski et al. | 211/85.3 |
| 2004/0181963 | A1 | 9/2004 | Morris | 34/103 |

FOREIGN PATENT DOCUMENTS

| | | | | |
|---|---|---|---|---|
| JP | 161533 | * | 6/1993 | 211/85.3 X |

* cited by examiner

*Primary Examiner*—Bruce A. Lev

(57) ABSTRACT

A compound adjustable garment supporting apparatus (100) is disclosed having first garment supporting assembly (102, 103, 104, 105) and second garment supporting assembly (121, 122, 123), each positioned at a different level above the floor. The first and second garment supporting assemblies are integrally connected together by a rod 112 for receiving external garment hangers.

20 Claims, 7 Drawing Sheets

GARMENT SUPPORTING STAND

RELATED APPLICATIONS

This is a continuation in part of U.S. application Ser. No. 09/704,952 filed Nov. 2, 2000 abandoned. This application is incorporated herein by reference.

FIELD OF THE INVENTION

The present invention relates to an apparatus configured to support garments at a convenient level above the floor.

BACKGROUND OF INVENTION

Garments are optimally maintained on garment supporting valets of size and height structured appropriately to the garment. Unsuitable sized or height of garment supporting valets will result in distortion at the shoulder portion or the bottom of the garment especially to the expensive knit wear, leather jackets and long overcoats. The correction result can be achieved either by using adjustable width/height garment supporting valets.

Garment supporting valets are equipped in the hotel rooms enabling the hotel guests to conveniently placing and supporting their jackets, pants, wallet, watch, jewelry and accessory. Hotel guests are of a wide range of body sizes. It is impossible for hotel operators to predict the body size and height of the hotel guests and to supply suitable fix sized garment supporting valets. Therefore the adjustable size garment supporting valet is a value added amenity for hotel operators to better service the hotel guests and protect their valued fashion and overcoat. Size adjustability of a garment supporting valet refers to the adjustment of the shoulder width and also the height of the valet. In addition to the convenience, the bulky size of an adjustable size garment supporting valet will prevent a premium adjustable garment hanger to be removed from the room by the customers.

It is the object of the subject invention to provide a garment supporting apparatus suitable for supporting one set of clothing, including a long over coat for a consumer, particularly a hotel guest.

The prior art is replete with various configurations of valets suitable for use in hotel rooms and domestic homes. Applicant's issued U.S. Pat. Nos. 6,176,400 disclosed some such structures as do certain ones of the references U.S. Patents D281,029, and U.S. Pat. No. 2,675,926, cited therein.

SUMMARY OF THE INVENTION

Garment supporting valets are equipped in the hotel rooms enabling the hotel guests to conveniently placing and supporting their jackets, pants, wallet, watch, jewelry and accessory. It is the objective of this invention to provide a compound garment supporting valet capable to support at least a full set of daily used clothing and accessories, including a jacket, long overcoat, a shirt, a pair of trousers, a skirt and a hat. All the garments are preferably positioned to face the same direction for a tidy coordination.

The present invention is directed to a compound valet having two adjustable garment hangers integrally mounted on a floor stand. The garment hangers may be incorporated with improved reciprocal adjustment mechanism for adjusting the hanger's width. An improved reciprocal transfer mechanism perfectly tracks the movement of both extension members and maintain the exact symmetry of the garment hanger.

According to one aspect of the present invention there is provided a first adjustable width garment hanger having first and second elongated supporting arms, first and second extension members mounted respectively for translation along the first and second support arms. The supporting arms are arranged at a downward angle from the medial portion of the garment hanger assembly for properly supporting the shoulder portions of a garment. The first adjustable width garment hanger is supported by a supporting member such as one or more supporting columns so that it is maintained "m" feet above the ground or floor level. The value of m is carefully defined so that the position of the first adjustable width garment hanger is suitable to keep most regular upper clothing or jackets well above the floor level. The garment supporting valet is also provided with a second adjustable width garment hanger similar in structure to the first hanger except that it is supported "n" feet above the floor level by another supporter; where n is a number carefully defined to support a long overcoat. A bar or beam is positioned in between the two garment supporting hangers to reinforce the slim tall structure. This beam or bar is also structured as a supporting rod to receive the hook or suspension members of external garment hangers that support shirts and trousers. On top of the first hanger is a convenience tray for the user to place their wallet, jewelry, pens and small accessories. On top of the much taller second hanger is a holding structure suitable to receive a hat, a necklace, a scarf or a wig. The lower ends of the two hanger supporters are integrally connected to a common base such that the two supporters are fixedly separated at a distance equal to the length of the beam or supporting rod. Integral connection is defined by the structural characteristic that the two supporting hangers are inseparable after assembly of the compound valet is completed and during normal application.

The dimension "m" is quite simple to be defined. It should be longer that the height of most upper clothing or jackets, with the position of the sleeve accounted. Since a convenience tray is structured on top of the first supporting hanger, the position of the tray should not be too tall to prohibit accessibility. Typical selection of this height is to have m equal to 3.5 or 4 feet, a distance between the garment supporting assembly and the floor level. Taking into the account of the thickness of the base and the depth of the garment supporting assembly, this measurement of m provides at least 2.5 feet of unobstructed clearance between the lower end of the hanger arm and the base for a regular jacket to be properly supported. Unobstructed clearance of unobstructed space is defined as a space free of any obstruction beneath the garment hanger, so that a garment supported by the garment hanger is freely suspended without any interference that may cause wrinkle to the bottom portion of the garment. Selecting the value of "n" is more complicated. It should be able to comfortably keep the long overcoat of a tall person well above the floor level. On the other hand it should be low enough for a short person to access the hat holder located on top of the second supporting garment hanger. Typical value of "n" to work with a tall person is 5.5 to 6.5 feet. This height is too tall for the convenient access of a short person. For that reason, a desire is discovered for the value of "n" to be adjustable by a user, in accordance to their body height.

Another characteristic of the embodiment is the position of the supporting rod, or beam structured to receive regular garment hangers. The location where the supporting beam connects to the lower supporting hanger assembly is preferred to be well above the medial portion of the lower garment hanger in order not for the supporting beam to interfere with the rear side of the upper clothing or jacket to be supported. Since the beam is to be horizontally positioned, the other end of the beam is therefore connected to the supporting member of the taller positioned hanger, a position below the medial portion of the taller positioned hanger. This arrangement does not create problem for a long over coat to be supported by the taller positioned hanger. This is because the front sides of most long overcoats are designed with a buttoned opening, which gives room for the centrally positioned supporting beam. When the height of the taller supporting hanger is to be adjusted, the adjustment mechanism should be positioned above the location of this horizontal connecting beam in order to maintain the rigidity of the assembly and the beam in the horizontal position.

Since the overcoat supporting hanger is located at a taller position and is required to support heavier weight, it is preferable for the supporting structure of this taller positioned hanger assembly to be equipped with two supporting columns. The lower positioned hanger for jackets may be supported by one or more columns as required. There are many different ways to design the supporting structure. For example, a rigid vertical standing board can be provided to replace the two supporting columns.

The function of the horizontal supporting beam is not only provided to receive any external garment hanger, which may be used to hold shirts, pants or skirts, this beam also forms an integral structural part to reinforce the stability between the two supporting hangers of the valet.

The bottoms of the columns supporting the two hanger assemblies are preferably to be connected with a base. Typical base designs are in the shape of a triangle, a circular shape, a frame, or a polygon structure. A base with bigger footprint provides a more solid three dimensional overall structure for the compound garment supporting valet.

There are many different ways to design the structure of the supporting member that supports the two garment supporting assembly above ground level. Multiple beams may be used. Alternately a solid board may be provided to replace two supporting beams. In another design the supporting member is represented by a single strong supporting column structured for supporting the two garment hangers and the beam in between. According to this embodiment the beam is divided into two segments, one segment is provided to connect between the supporting member and the lower garment hanger assembly, while the second segment can be configured to support the second garment supporting assembly located at a higher position than the first garment hanger assembly. When two different connecting beams are used, the structure or shape of each beam can be modified for best supporting the two different positioned garment hanger assembly and for receiving external garment hangers.

There are also many different ways to design the base for supporting the two garment supporting assemblies. In another embodiment, each garment supporting assembly is supported by an independent supporting column located on top of a separated base. The two bases are then connected together by another horizontal beam. Another base design comprises a rotating means that enable the upper portion of the base to rotate relative to the lower portion of the base, such that the top portions of the valet can be rotated relative to the floor.

As a summary of the invention, a compound garment supporting valet is disclosed to comprise a first pair of supporting arms located at a first lower position to support a jacket, a second pair of supporting arms located at a second higher position for supporting a long over coat, a beam located below said second supporting hanger is provided for receiving additional external hangers that support shirts and pants; and a supporting structure to suitably support said first supporting hanger, second supporting hanger and said beam above a floor, preferably with a base.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
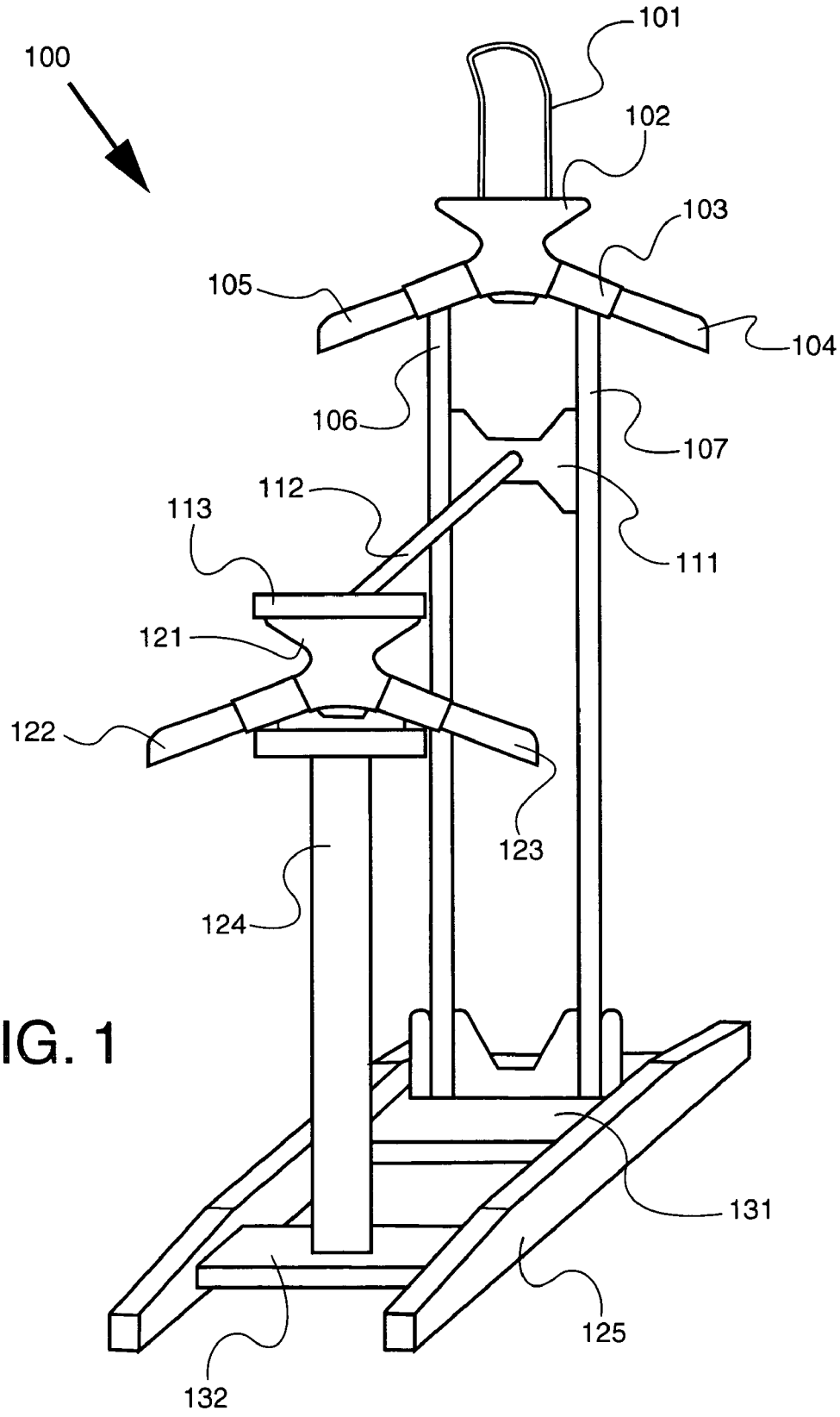
FIG. 1 is a three dimensional view of a preferred embodiment showing a compound adjustable garment supporting valet in accordance with the present invention.

FIG. 1 is a three dimensional view illustrating a preferred embodiment of the compound adjustable valet structured in accordance with the present invention. The garment supporting apparatus 100 includes a first adjustable garment supporting assembly 102 mounted onto a floor standing frame formed by the supporters 106, 107 and the base 125. The adjustable garment supporting assembly has a pair of elongate support arms 103. The terminal ends of the arms 103 are arranged to define a downward obtuse angle from the center point of the medial portion 102 and respectively carry slidable extension members 104, 105. The extension members respectively slide along the supporting arms 103 reciprocally with the support of a transfer mechanism located inside the medial portion 102. Movement of the extension members 104, 105 can be accomplished by grasping each extension member in one hand and urging them inward or outward. Alternatively, the frame can be grasped in one hand and either of the extension members urged inward or outward with the other hand. On top of the first adjustable garment supporting assembly is a holding structure 101 to support a hat, a wig, a necklace or a scarf. The extension members 104, 105 are supported by the columns 106, 107 such that they are "n" feet above the floor level. "n" is typically equal to 4 to 6 feet, preferably to be adjustable for supporting a long overcoat.

The next part of the preferred embodiment is a second adjustable garment supporting assembly comprising the medial portion 121, and the extension arms 122, 123. This structure is identical to the first garment supporting assembly except that it is positioned at a lower level to support a regular upper clothing or jacket. The supporting column 124 defines the level "m" of the arms 122, 123 above the floor level. The lower end of the supporting column 124 is connected to the base 125. Typically this second garment supporting assembly is positioned at 2.5 to 4.5 feet above the floor. On top of the second garment supporting assembly is a convenience tray 113 structured to hold wallet, jewelry, watch, pen or any small personal accessories. Although each of the illustrated garment hanger assembly represents an adjustable garment hanger, the definition of the garment supporting assembly includes the structure of any commercial available garment hangers including but not limited to the single piece hangers.

In between the two garment supporting assemblies 102 and 121 is a beam or rod 112. One end of the beam 112 is connected to the top portion of the second garment supporting hanger or assembly 121, well above the shoulder supporting arms of the assembly 121, such that any clothing hanging on the assembly 121 is not interfered by the rod 112. The other end of the rod 112 is positioned at a level below the medial portion of the garment supporting assembly 102. According to the structure of this embodiment, the beam 112 is connected to a plate 111 positioned in between the supporting columns 106, 107. The beam 112 is horizontally positioned to receive the suspension members, or hooks of external regular garment hangers holding shirts, skirts or pants.

It should be noted that the medial portions of the upper and lower garment supporting assemblies define a vertical plane. This plane also represents the symmetrical center plane of the whole garment supporting apparatus. The location of the vertical plane as defined by the centerlines of the medial portions 102, 121 as illustrated by the plane 403 of FIG. 4B. The horizontal beam 112 configured to receive external hangers is preferred to be positioned right on this plane for a good looking symmetrical arrangement for the garments supported by the valet.

On top of the lower garment supporting assembly is a convenience tray 113 provided for the user to store the wallet and smaller accessory items such as pen and watch.

Figure 2:
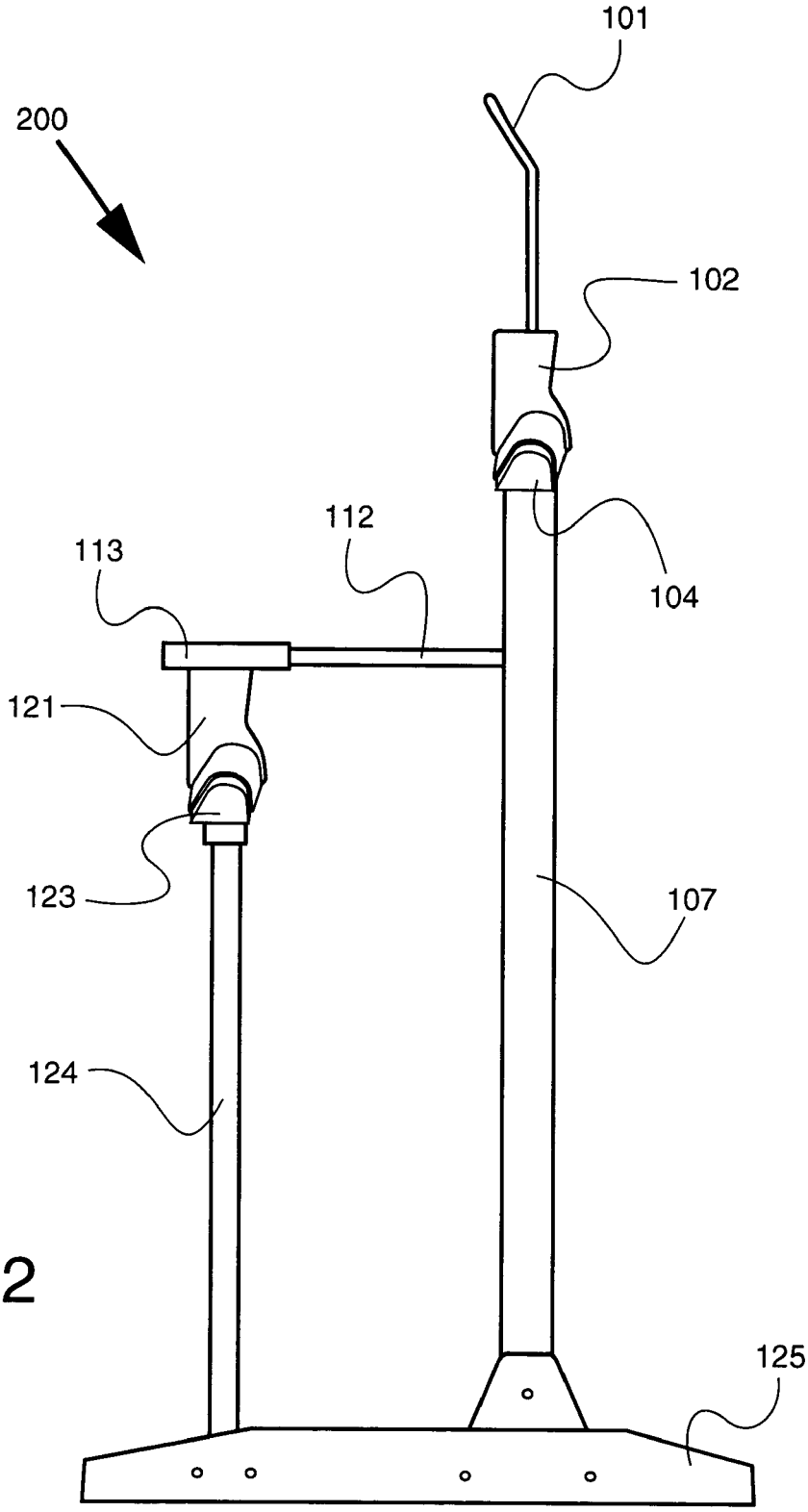
FIG. 2 is the side view of the embodiment illustrated in FIG. 1.

FIG. 2 is the side view of the assembly 100. It can be observed that at least a part of the holding structure 101 on top of the assembly 102 is tilted to one side to conveniently support a hat or a wig. The bottom portion of the holding structure is suitable for supporting a necklace or a scarf. The beam 112 is connected to the convenience tray 113 on one end and the supporting structure of the hanger assembly 102 on the other end. The position below the beam 112 is unobstructed for the assembly 121 to receive a jacket or an upper clothing. When the hanger assembly 102 supports a long overcoat, the beam 112 emerges from the front opening of the overcoat to provide an unobstructed space beneath between the supporting arms 104 and the base 125.

Attention is now directed to the base 125, which connects the supporting columns 124, 107 to form a solid integral compound valet. The bottoms of the supporting columns are separated by a distance equal to the length of the beam 112 so that the supporting columns are solidly maintained at a vertical position. If the height of the supporting column 107 is to be adjusted, the adjustment mechanism should be located in between the level of the beam 112 and the extension arm 104 in order for the rigidity of the frame to be maintained. The preferred position of the adjustment mechanism is also illustrated as the element 401 in FIG. 4B. In accordance to the design of this embodiment, there are three supporting columns 106, 107 and 124. The lower ends of these columns are connected to the base 125. The base 125 can be of different shape according to the favor of the visual designer. It should be noted that the illustrated supporting members and base are exemplary and there are many different design modifications possible to serve the purpose of supporting the two garment supporting assemblies at different levels, and to provide a garment hanger supporting beam in between.

Figure 4A:
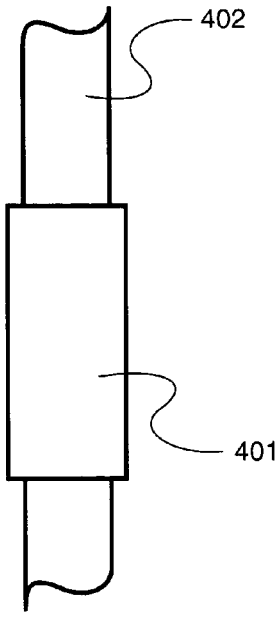
FIG. 4A represents an embodiment of the adjustment mechanism to adjust the height of a supporting structure.
Figure 4B:
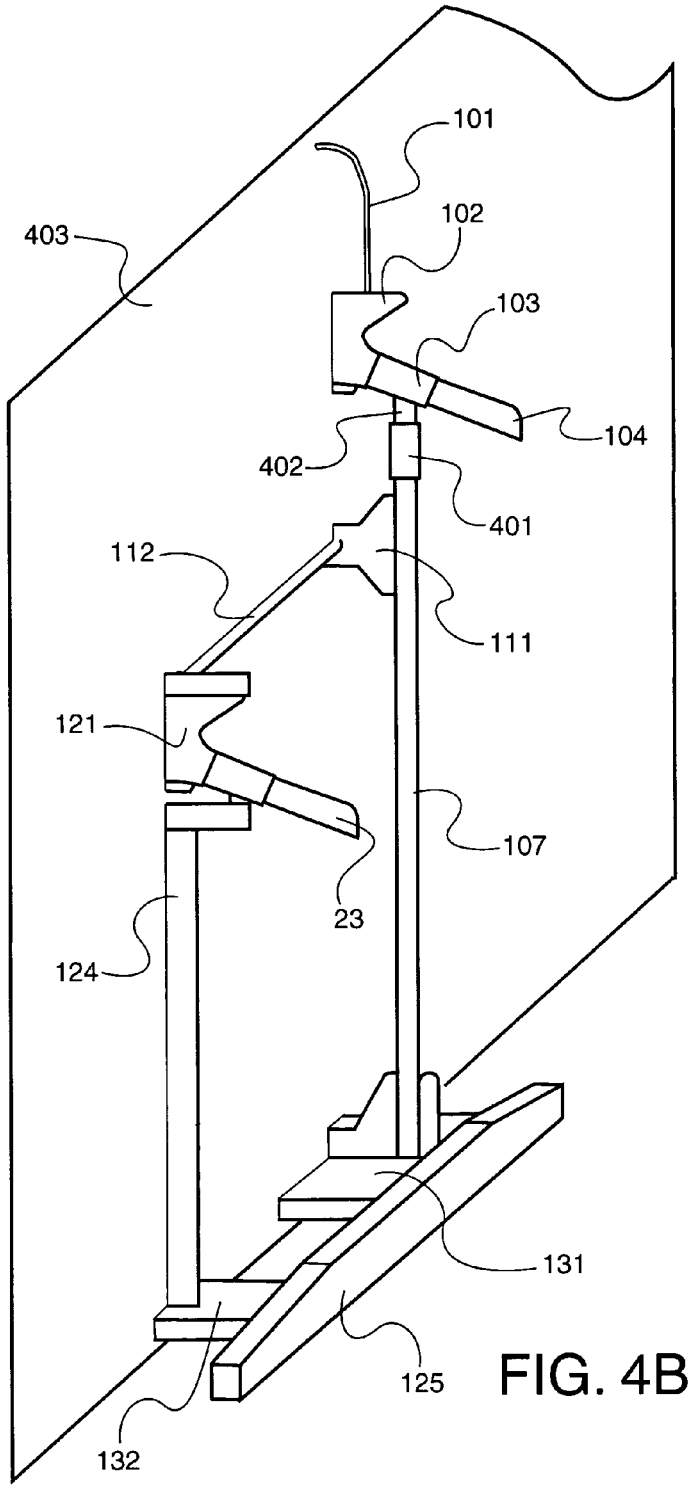
FIG. 4B demonstrates the location of the medial position vertical plane.

FIG. 4A represents a conventional adjustment mechanism located along the supporting beams 106, 107 to adjust the height of a supporting structure. The preferred location of the adjustment mechanism is represented by the element 401 of FIG. 4B. Element 401 allows the supporting beam 402 to move relative from 401 so as to adjust the vertical level of the supporting hanger assembly. There are various structures to vary the length of a supporter well known to an ordinary person skill in the art, such as a tripod used to hold a camera. All these structures are exemplary and included in the scope of the invention.

Figure 3:
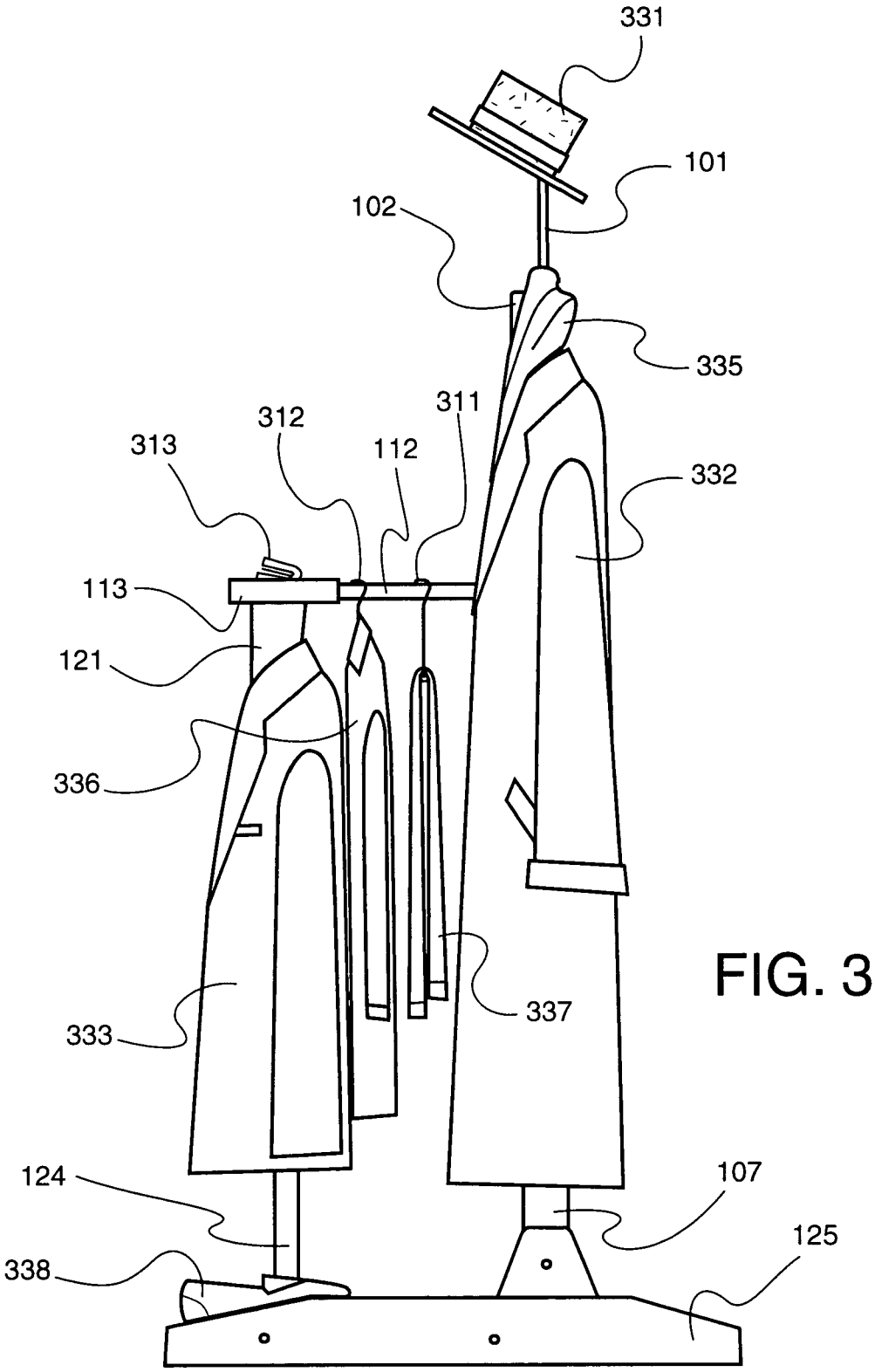
FIG. 3 illustrates a side view of FIG. 2 having garments supported by the preferred embodiment.

Attention is now directed to FIG. 3, which illustrates the side view of the valet being used by a user. At the top of the holding structure 101 is a hat 331. The lower end of the holding structure 101 and the upper region of the neck shape medial portion 102 is surrounded by a scarf 335. It should be noted that in this design the upper elongated portion of the medial structure 102 can be considered to be an extension of the holder structure 101. The shoulder arms of the garment supporting assembly 102 properly support a long overcoat 332. The beam 112 emerging from the front opening of the long overcoat 332 supports two regular garment hangers 311 and 312, that in turn support a pair of trousers 337 and a shirt 336. The unobstructed space between the supporting arms of the higher positioned garment supporting assembly 102 and the base 125 is important to provide interference free support to the long overcoat 332. The lower garment supporting assembly 121 is also designed to provide an unobstructed space beneath its supporting arms for properly supporting the jacket 333. On top of the convenience tray 113 are the wallet 313 and other small accessories of the user. The shoes 338 of the user are placed on top of the base 125. It can be observed that the invented valet is an optimal garment supporting apparatus designed to support a full set of daily clothing for a user. It can also be observed that all the daily used garments are properly supported and facing the same direction for a well coordinated and tidy look of the room.

Figure 5:
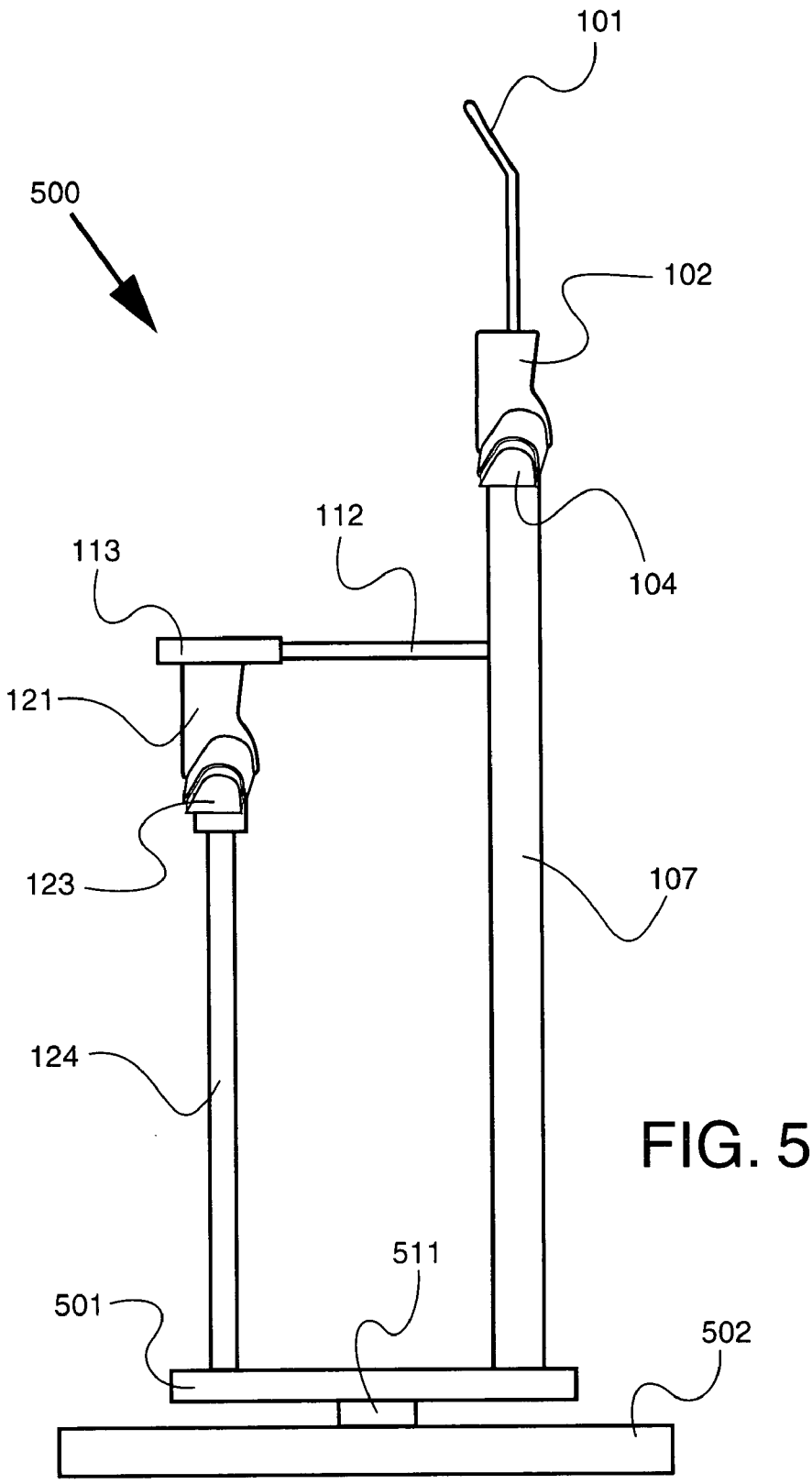
FIG. 5 illustrates another preferred embodiment demonstrating an alternate design of the base.

FIG. 5 illustrated a modified base that allows the valet to be rotated against the floor. The supporting columns 107 and 124 of the valet are extended from an upper platform 501 of the base. The upper platform 501 is connected to the bottom platform 502 with a rotational mechanism 511, such that the platform 501 can be rotated relative to the bottom platform 502. This optional design allows the user to conveniently rotating the valet to access the garments and accessories it supported.

Figure 6:
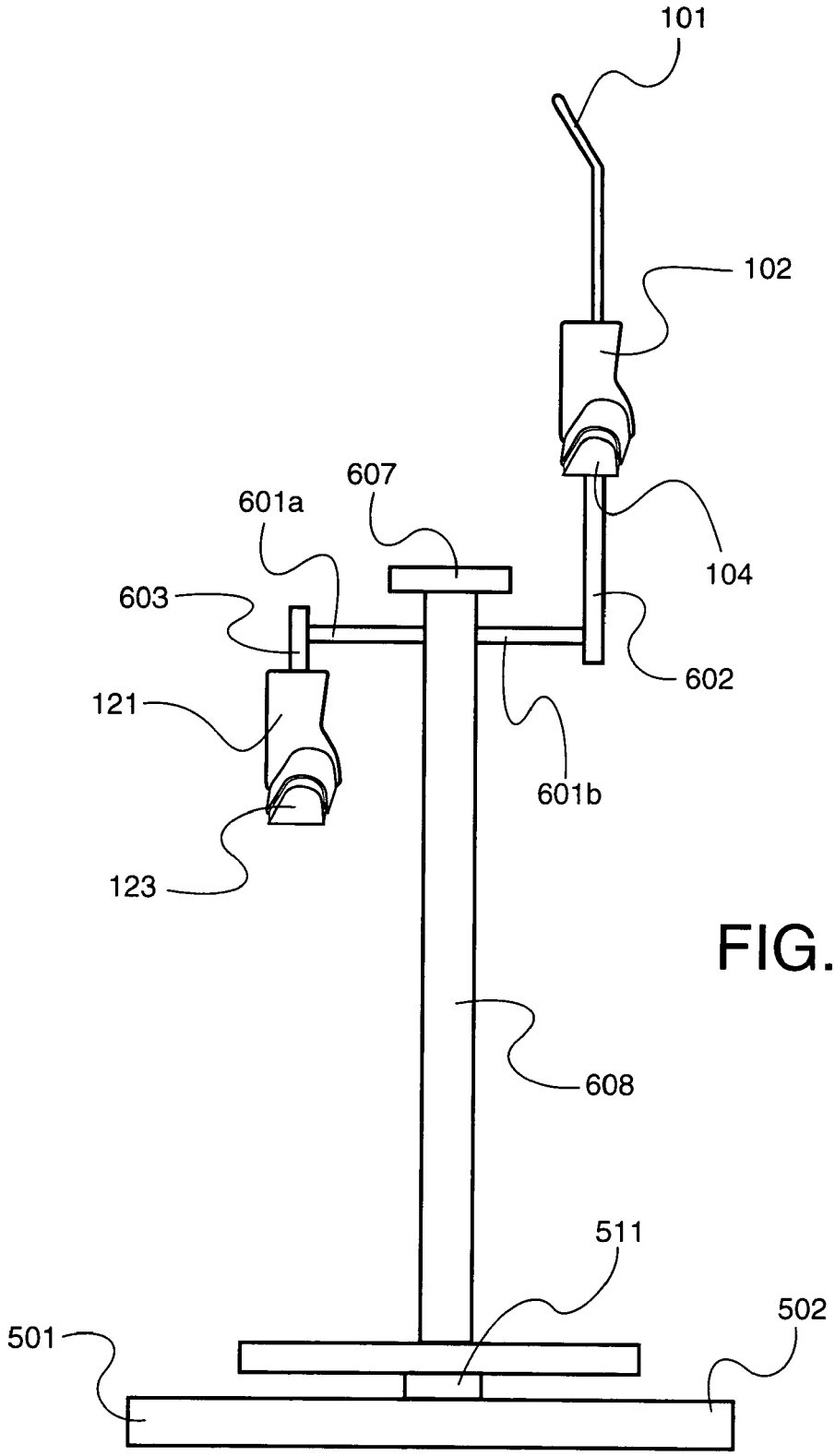
FIG. 6 illustrates another preferred embodiment demonstrating an alternate supporting structure.

Attention is now directly to another preferred embodiment illustrated in FIG. 6. The supporting member 608 of the two garment supporting assemblies is formed in the shape of a single column. The column 608 supports the higher positioned garment supporting assembly 102 by the horizontal beam 601*b* and the connecting column 602. The column 608 is also connected to the beam 601*a* that supports the assembly 121 by another connecting column 603. It should be noted that the columns 602, 603 can be defined as the separated segments of the supporting beam located in between the two garment supporting assemblies. The convenience tray 607 is relocated to the top of the supporting member 608. The hooks of the external hangers that support shirt and trousers can be received by the beams 601*a* and 601*b*. It should be noted that the beams 601*a* and 601*b* can be part of the same beam, or two separated components connected to the supporting member 608. It should also be noted that the beam 601*a* is connected to a region located on top of the medial portion 121 to provide an unobstructed space beneath the supporting arms 123.

Figure 7:
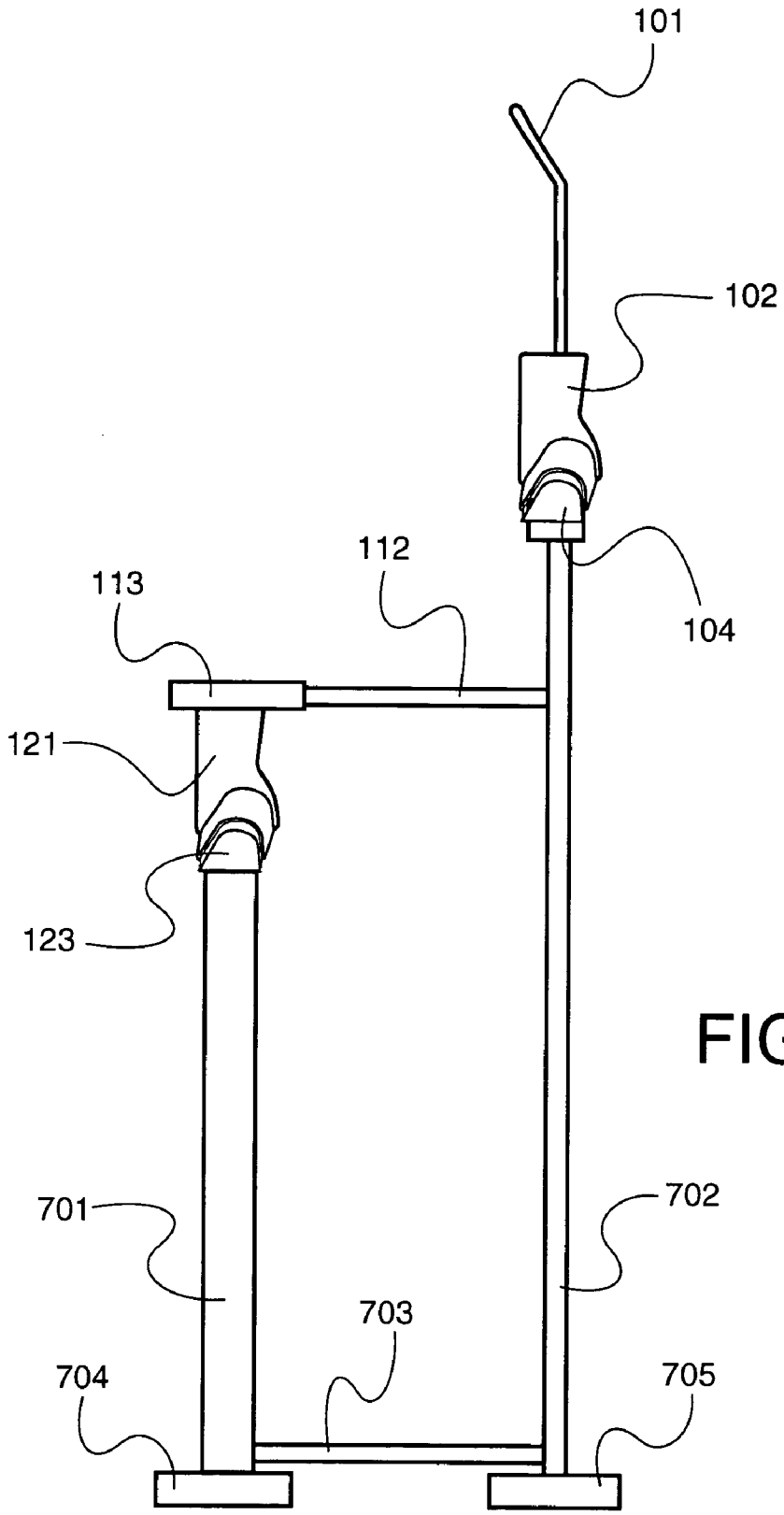
FIG. 7 illustrates another preferred embodiment demonstrating an alternate design of the supporting structure and the base.

FIG. 7 illustrates another modified embodiment of the valet of FIG. 2 with a simpler base structure. The front lower garment supporting assembly 121 is supported by two supporting columns 701 similar in structure to the supporting columns 106 and 107 of FIG. 1. The rear higher position garment supporting assembly 102 is supported by a wide plat panel 702. Each of the supporting columns 701 and supporting panel 702 are connected to two different bases 704 and 705 respectively. The base 704 and 705 are of identical look to the platforms 132 and 131 of FIG. 1. In order to strengthen the rigidity of the bases, a beam located close to the floor level is provided to connect the two bases 704, 705 or the supporting members 701 and 702 together. From here it can be observed that there are many different possible ways to design the supporting structure and the base. Accordingly the broad term definition of the supporting member that supports the two garment supporting assemblies and the horizontal beam includes one or more supporting structures that are configured to keep the garment supporting assemblies above the supporting surface. In accordance to the illustrated embodiments and the goal of the invention, the supporting member is also configured to provide adequate unobstructed spaces beneath the hanger arms of the garment supporting assemblies.

From the foregoing it should now be recognized that the embodiment of an adjustable compound valet formed by two garment supporting assemblies positioned at different heights and a supporting beam to receive external garment hangers has been disclosed herein conveniently suited to hold a full set of the daily used clothing and personal accessories of a hotel guest. It should be understood that although embodiments have been disclosed for use in hotel guest rooms, it is possible to extend the use of the invention in household, offices and bathrooms. Although adjustable garment hangers are proposed to form the garment supporting assemblies, other regular or simple garment hangers may be used to represent the garment supporting assembly recited. The preferred embodiment of the invention described herein is exemplary and numerous modifications, alternate shapes, dimensional variations and rearrangements can be readily envisioned to achieve an equivalent result, all of which are intended to be embraced within the scope of the appended claims.

I claim:

1. A garment supporting apparatus comprising a first garment supporting member having a first pair of extended arms extended laterally from a first medial position;

a second garment supporting member having a second pair of extended arms extended laterally from a second medial position; each of said first and second pair of extended arms are arranged at a downward angle from said first and second medial portions for supporting a garment and at least one of said garment supporting members is fixedly secured relative to said garment supporting apparatus;

a supporting structure configured to support said first garment supporting member at a first distance above a supporting surface and said second garment supporting member at a second distance above said supporting surface, wherein said second distance is greater than said first distance;

a beam extending between said first and second garment supporting members from a region on top of the medial position of said first garment supporting member; and said garment supporting members are structured to provide an unobstructed space for said second garment supporting member to properly support a long over coat.

2. The garment supporting apparatus of claim 1 wherein said beam is structured for receiving the suspension member of an external garment hanger.

3. The garment supporting apparatus of claim 1 wherein said second distance is adjustable by a user.

4. The garment supporting apparatus of claim 1 wherein said beam is connected to said supporting structure.

5. The garment supporting apparatus of claim 1 further comprising a holding structure positioned on top of said second garment supporting member for supporting a hat, a wig, a neck lace or a scarf.

6. The garment supporting apparatus of claim 1 further comprising a tray located on top of said first garment supporting member or on top of said supporting structure.

7. The garment supporting apparatus of claim 1 wherein in said supporting structure extends from a base.

8. The garment supporting apparatus of claim 1 wherein said beam comprises of two or more separated segments.

9. The garment supporting apparatus of claim 8 wherein said base comprises rotating means for said supporting member to rotate relative from said base.

10. The garment supporting apparatus of claim 1 wherein said beam extends to a region beneath the medial position of said second garment supporting member.

11. The garment supporting apparatus of claim 1 wherein said beam extends along a vertical plane defined by the medial positions of said first and second garment supporting members.

12. A garment supporting apparatus comprising a first garment supporting member having a first pair of extended arms extended laterally from a first medial position;

a second garment supporting member having a second pair of extended arms extended laterally from a second medial position; each of said first and second pair of extended arms are arranged at a downward angle from said first and second medial portions for supporting a garment;

supporting structure configured to support said first garment supporting member at a first distance above a supporting surface and said second garment supporting member at a second distance above said supporting surface, wherein said second distance is greater than said first distance;

a beam extending between said first and second garment supporting members from a region beneath the medial position of said second garment supporting member; and said garment supporting apparatus are structured to provide an unobstructed space for said second garment supporting member to properly support a long over coat.

13. The garment supporting apparatus of claim 12 wherein said beam extends to a region on top of the medial position of said first garment supporting member.

14. The garment supporting apparatus of claim 12 wherein said beam extends along a vertical plane defined by the medial positions of said first and second garment supporting members.

15. A garment supporting apparatus comprising a first garment supporting member having a first pair of extended arms extended laterally from a first medial position;

a second garment supporting member having a second pair of extended arms extended laterally from a second medial position; each of said first and second pair of extended arms are arranged at a downward angle from said first and second medial portions for supporting a garment;

supporting structure configured to support said first garment supporting member at a first distance above a supporting surface and said second garment supporting member at a second distance above said supporting surface, wherein said second distance is greater than said first distance;

a first beam positioned at least three feet from said supporting surface and extended between said first and second garment supporting members along a vertical plane defined by the medial positions of said first and second garment supporting assembly; and said garment supporting apparatus are structured to provide an unobstructed space for said second garment supporting member to properly support a long over coat.

16. The garment supporting apparatus of claim 15 wherein said first beam extends from a region on top of the medial position of said first garment supporting member.

17. The garment supporting apparatus of claim 15 wherein said first beam extends from a region beneath the medial position of said second garment supporting member.

18. The garment supporting apparatus of claim 15 further comprising a second beam wherein said first beam is configured for said supporting structure to support said first garment supporting assembly and said second beam is configured for said supporting structure to support said second garment supporting assembly.

19. The garment supporting apparatus of claim 15 further structured to provide at least two and half feet of unobstructed space between said first garment supporting member and said supporting surface.

20. The garment supporting apparatus of claim 15 further structured to provide at least four feet of unobstructed space between said second garment supporting member and said supporting surface.

* * * * *